US008607846B2

(12) United States Patent
Yamamoto et al.

(10) Patent No.: US 8,607,846 B2
(45) Date of Patent: Dec. 17, 2013

(54) MOLD AND MOLDING MANUFACTURING METHOD

(75) Inventors: Satoshi Yamamoto, Sakai (JP); Mikio Kajiwara, Sakai (JP); Ryohei Deguchi, Sakai (JP); Toshio Ohkado, Himeji (JP); Shuichi Shikai, Himeji (JP); Susumu Nishikawa, Himeji (JP)

(73) Assignees: Daikin Industries, Ltd., Osaka (JP); Kogi Corporation, Hyogo (JP)

( * ) Notice: Subject to any disclaimer, the term of this patent is extended or adjusted under 35 U.S.C. 154(b) by 223 days.

(21) Appl. No.: 12/999,664

(22) PCT Filed: Jun. 19, 2009

(86) PCT No.: PCT/JP2009/002807

§ 371 (c)(1),
(2), (4) Date: Dec. 17, 2010

(87) PCT Pub. No.: WO2009/154005

PCT Pub. Date: Dec. 23, 2009

(65) Prior Publication Data

US 2011/0088863 A1 Apr. 21, 2011

(30) Foreign Application Priority Data

Jun. 20, 2008 (JP) ..... 2008-162058

(51) Int. Cl.
*B22D 29/00* (2006.01)
*F01C 1/02* (2006.01)

(52) U.S. Cl.
USPC ..... 164/69.1; 418/54; 418/55.1

(58) Field of Classification Search
USPC ..... 164/69.1; 418/54–67
See application file for complete search history.

(56) References Cited

U.S. PATENT DOCUMENTS

| | | | | | |
|---|---|---|---|---|---|
| 5,580,401 | A * | 12/1996 | Williamson | ..... | 148/321 |
| 6,086,341 | A * | 7/2000 | Fukuhara et al. | ..... | 418/55.2 |
| 7,540,726 | B2 * | 6/2009 | Matsuhashi | ..... | 418/1 |
| 2002/0148592 | A1 * | 10/2002 | Mori et al. | ..... | 164/137 |
| 2004/0211539 | A1 * | 10/2004 | Hong | ..... | 164/113 |

FOREIGN PATENT DOCUMENTS

| | | | |
|---|---|---|---|
| JP | 2002-219553 | A | 8/2002 |
| JP | 2004-17100 | A | 1/2004 |
| JP | 2005-36693 | A | 2/2005 |

OTHER PUBLICATIONS

International Preliminary Report of corresponding PCT Application No. PCT/JP2009/002807.
International Search Report of corresponding PCT Application No. PCT/JP2009/002807.

* cited by examiner

*Primary Examiner* — Kevin P Kerns
*Assistant Examiner* — Steven Ha
(74) *Attorney, Agent, or Firm* — Global IP Counselors

(57) ABSTRACT

A mold includes a first groove part and a second groove part. The first groove part extends with a constant length or a constant width from a center part to an outer circumferential part of the mold. The second groove part extends from a terminal end of the first groove part on an outer circumferential part side of the first groove and merges with any portion of the first groove part. A molding manufacturing method includes manufacturing a preform by semimolten die casting or semisolid die casting using the mold. The method may also include removing a portion of the preform corresponding to the second groove part.

8 Claims, 17 Drawing Sheets

PRIOR TO MOLDING AFTER MOLDING

MOLD CENTER PART TEMPERATURE

MOLD AND MOLDING MANUFACTURING METHOD

CROSS-REFERENCE TO RELATED APPLICATIONS

This U.S. National stage application claims priority under 35 U.S.C. §119(a) to Japanese Patent Application No. 2008-162058, filed in Japan on Jun. 20, 2008, the entire contents of which are hereby incorporated herein by reference.

TECHNICAL FIELD

The present invention relates to a mold for manufacturing a molding by a semimolten die casting method or a semisolid die casting method. In addition, the present invention relates to a method of using the mold to manufacture the molding by the semimolten die casting method or the semisolid die casting method.

BACKGROUND ART

In the conventional art, a molding manufacturing method wherein "a preform is formed by a semimolten die casting method into a near net shape, the preform is subject to ultra-precision finishing, and thereby a target molding is obtained" has been proposed (e.g., refer to Japanese Laid-open Patent Application Publication No. 2005-36693). Adopting this manufacturing method makes it possible to manufacture a molding that is stronger than the molding obtained by the casting method and, moreover, to reduce the cost of raw materials, machining, tool supplies, and the like as well as to reduce waste matter such as grinding waste material and machining waste liquid.

SUMMARY

Technical Problem

However, when manufacturing a molding by, for example, the semimolten die casting method or the semisolid die casting method, any grooves in the mold that extend from a center part to the outer circumferential part will suffer cracks in the vicinity of their end parts on the outer circumferential part side, and the number of molding shots will be significantly fewer than that normally expected during the life of the mold, which is a problem.

An object of the present invention is to increase the life of a mold when manufacturing a molding by a semimolten die casting method or a semisolid die casting method.

Solution to Problem

A mold according to a first aspect of the present invention is a mold that comprises a first groove part and a second groove part. The first groove part extends with a constant length or a constant width from a center part to an outer circumferential part. The second groove part extends from a terminal end of the first groove part on the outer circumferential part side and merges with any portion of the first groove part. Furthermore, a pouring gate is provided in the vicinity of the end part of the first groove part on the center side.

Incidentally, in a case where a conventional mold, which comprises only the first groove part, is used in semimolten die casting, semisolid die casting, or the like, when the high temperature semimolten metal is pressurized and fills the mold, a force is generated that presses against a groove wall in the vicinity of a groove end on the outer circumferential part side of the first groove part (hereinbelow, called an "outer circumferential end groove wall"). In other words, at this time, the outer circumferential end groove wall bears a tensile load. Meanwhile, when a molded part is removed from such a mold, the temperature of the mold decreases starting from the outer circumferential side. At this time, a large temperature differential arises between the center part and the outer circumferential part of the mold, and a compressive load owing to thermal expansion is generated in the outer circumferential end groove wall. Accordingly, in such a mold, the outer circumferential end groove wall alternately and repetitively bears a tensile load owing to pressurization and a compressive load owing to thermal expansion; as a result, stress amplitude is created in the outer circumferential end groove wall. Furthermore, if the stress amplitude exceeds the fatigue limit of the material of the mold, then a fatigue failure will occur and a crack will be created in the outer circumferential end groove wall.

However, in the mold according to the present invention, the second groove part is formed, and consequently the outer circumferential end groove wall does not exist. In other words, in this mold, the stress amplitude is not generated. Consequently, the mold according to the present invention has an increased lifespan.

Note that, to obtain the target molding, the portion corresponding to the second groove part should be removed from the preform using a technique such as cutting.

A mold according to a second aspect of the present invention is a mold according to the first aspect of the present invention wherein, the first groove part is a scroll shaped groove part that extends in one direction while maintaining a scroll shape. The second groove part extends from a scroll tail end of the scroll shaped groove part and merges with any portion of the scroll shaped groove part. Furthermore, the outer periphery of the second groove part is preferably either an arc or comprises an arc and a tangent that extends from an arbitrary point along the outer periphery of the scroll shaped groove part. In addition, in this mold, the scroll shaped groove part may extend in one direction from the end surface or may extend in one direction from a recessed part (i.e., a portion corresponding to an end plate).

In this mold, the first groove part is the scroll shaped groove part that extends in one direction while maintaining its scroll shape. Furthermore, the second groove part extends from the scroll tail of the scroll shaped groove part and merges with any portion of the scroll shaped groove part. Consequently, it is possible to increase the lifespan of a mold for a scroll member.

A mold according a third aspect of the present invention is the mold according to the second aspect of the present invention wherein, when the second groove part is viewed in the depth directions, an outer periphery of the second groove part is an arc.

In a case where the scroll shaped groove part is formed in the mold, if the outer periphery of the second groove part is made arcuate when the second groove part is viewed in the depth directions, then it is possible to prevent the groove wall of the second groove part from bearing the tensile load owing to pressurization and the compressive load owing to thermal expansion. Consequently, the lifespan of this mold increases.

A mold according to a fourth aspect of the present invention is the mold according to the second aspect of the present invention wherein, when the second groove part is viewed in the depth directions, an outer periphery of the second groove part has an arc and a tangent, which extends from an arbitrary point along the outer periphery of the scroll shaped groove part.

In a case where the scroll shaped groove part is formed in the mold, if the outer periphery of the second groove part comprises the arc and the tangent that extends from the arbitrary point along the outer periphery of the scroll shaped groove part when the second groove part is viewed in the depth directions, then it is possible to prevent the groove wall of the second groove part from bearing the tensile load owing to pressurization and the compressive load owing to thermal expansion. Consequently, the lifespan of this mold increases.

A mold according to a fifth aspect of the present invention is the mold according to the first aspect of the present invention wherein, the first groove part is a plurality of groove parts, the groove parts extending radially from the center part to the outer circumferential part. In addition, the second groove part merges with the terminal end portions of all of the first groove parts on the outer peripheral part sides.

In this mold, the first groove part is a plurality of groove parts, the groove parts extending radially from the center part to the outer circumferential part. Furthermore, the second groove part merges with the terminal end portions of all of the first groove parts on the outer peripheral part sides. Consequently, it is possible to increase the lifespan of a mold for a molded part that comprises radial reinforcing ribs and the like.

A molding manufacturing method according to a sixth aspect of the present invention comprises the step of: using a mold according to any one aspect of the first through fifth aspects of the invention to manufacture a preform by a semimolten die casting method or a semisolid die casting method.

Incidentally, in a case where a conventional mold, which comprises only the first groove part, is used in semimolten die casting, semisolid die casting, or the like, when the high temperature semimolten metal is pressurized and fills the mold, a force presses against the outer circumferential end groove wall of the first groove part. In other words, at this time, the outer circumferential end groove wall bears a tensile load. Meanwhile, when a molded part is removed from such a mold, the temperature of the mold decreases starting from the outer circumferential side. At this time, a large temperature differential arises between the center part and the outer circumferential part of the mold, and a compressive load owing to thermal expansion is generated in the outer circumferential end groove wall. Accordingly, in such a mold, the outer circumferential end groove wall alternately and repetitively bears a tensile load owing to pressurization and a compressive load owing to thermal expansion; as a result, stress amplitude is created in the outer circumferential end groove wall. Furthermore, if the stress amplitude exceeds the fatigue limit of the material of the mold, then a fatigue failure will occur and a crack will be created in the outer circumferential end groove wall.

However, in the mold according to the first through fifth aspects of the present invention, the second groove part is formed, and consequently the outer circumferential end groove wall does not exist. In other words, in this mold, the stress amplitude is not generated. Consequently, the mold according to the present invention has an increased lifespan. Accordingly, using this molding manufacturing method makes it possible to reduce the cost of the mold and to manufacture such a molding inexpensively.

A molding manufacturing method according to a seventh aspect of the present invention comprises a preform manufacturing process and an eliminating process. In the preform manufacturing process, a mold according to any one aspect of the first through fifth aspects of the invention is used to manufacture a preform by a semimolten die casting method or a semisolid die casting method. In the eliminating process, a portion corresponding to the second groove part of the preform is removed.

Incidentally, in a case where a conventional mold, which comprises only the first groove part, is used in semimolten die casting, semisolid die casting, or the like, when the high temperature semimolten metal is pressurized and fills the mold, a force presses against the outer circumferential end groove wall of the first groove part. In other words, at this time, the outer circumferential end groove wall bears a tensile load. Meanwhile, when a molded part is removed from such a mold, the temperature of the mold decreases starting from the outer circumferential side. At this time, a large temperature differential arises between the center part and the outer circumferential part of the mold, and a compressive load owing to thermal expansion is generated in the outer circumferential end groove wall. Accordingly, in such a mold, the outer circumferential end groove wall alternately and repetitively bears a tensile load owing to pressurization and a compressive load owing to thermal expansion; as a result, stress amplitude is created in the outer circumferential end groove wall. Furthermore, if the stress amplitude exceeds the fatigue limit of the material of the mold, then a fatigue failure will occur and a crack will be created in the outer circumferential end groove wall.

However, in the mold according to the first through fifth aspects of the present invention, the second groove part is formed, and consequently the outer circumferential end groove wall does not exist. In other words, in this mold, stress amplitude is not generated. Consequently, the mold according to the present invention has an increased lifespan. Accordingly, using this molding manufacturing method makes it possible to reduce the cost of the mold and to manufacture such a molding inexpensively.

Advantageous Effects of Invention

According to a first aspect of the invention, it is possible to increase the lifespan of a mold for semimolten die casting, semisolid die casting, or the like.

According to a second aspect of the invention, it is possible to increase the lifespan of a mold for a scroll member.

According to a third and fourth aspect of the invention, it is possible to increase the lifespan of a mold for semimolten die casting, semisolid die casting, or the like.

According to a fifth aspect of the invention, it is possible to increase the lifespan of a mold for a molded part that comprises radial ribs and the like.

The use of a molding manufacturing method according to a sixth aspect of the invention makes it possible to increase the lifespan of a mold as well as to reduce the cost of the mold and to manufacture a molding inexpensively.

The use of a molding manufacturing method according to a seventh aspect of the invention makes it possible to increase the lifespan of a mold as well as to reduce the cost of the mold and to manufacture a molding inexpensively.

DESCRIPTION OF EMBODIMENTS

The text below explains a compressor, wherein a sliding part is used, according to an embodiment of the present invention, using a high/low pressure dome type scroll compressor as an example. Furthermore, the high/low pressure dome type compressor according to the embodiment of the present invention is designed such that it can withstand the use of a high pressure refrigerant, such as carbon dioxide refrigerant ($CO_2$) or R410A.

Figure 1:
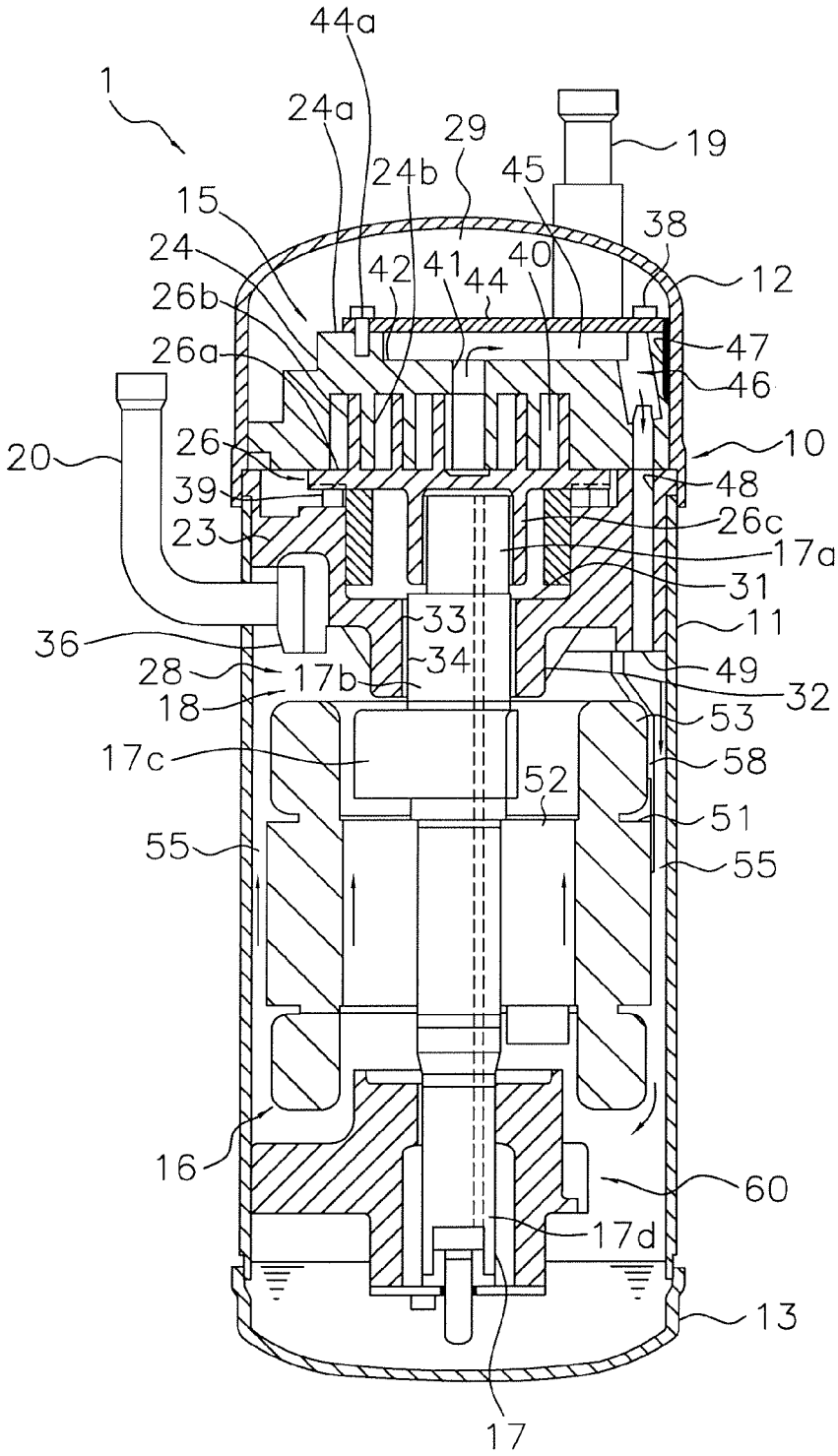
FIG. 1 is a longitudinal cross sectional view of a high/low pressure dome type scroll compressor according to an embodiment of the present invention.

A high/low pressure dome type scroll compressor 1 according to the embodiment of the present invention comprises an evaporator, a condenser, an expansion mechanism, and the like as well as a refrigerant circuit and serves to compress a gas refrigerant inside the refrigerant circuit; furthermore, as shown in FIG. 1, the high/low pressure dome type scroll compressor 1 principally comprises a cylindrical hermetic dome type casing 10, a scroll compression mechanism 15, an Oldham ring 39, a drive motor 16, a lower part main bearing 60, a suction pipe 19, and a discharge pipe 20. The text below discusses the constituent parts of the high/low pressure dome type scroll compressor 1 in detail.

<Details of Constituent Parts of the High/Low Pressure Dome Type Scroll Compressor>

(1) Casing

The casing 10 is a hermetic container and principally comprises a substantially cylindrical trunk casing part 11, a bowl shaped upper wall part 12, and a bowl shaped bottom wall part 13. The upper wall part 12 is welded to an upper end part of the trunk casing part 11. The bottom wall part 13 is welded to a lower end part of the trunk casing part 11. Furthermore, the casing 10 principally houses the scroll compression mechanism 15, which compresses the gas refrigerant, and the drive motor 16, which is disposed below the scroll compression mechanism 15. The scroll compression mechanism 15 and the drive motor 16 are coupled by a crankshaft 17, which is disposed inside the casing 10 such that it extends in the vertical directions. Furthermore, as a result, a gap space 18 is created between the scroll compression mechanism 15 and the drive motor 16.

(2) Scroll Compression Mechanism

As shown in FIG. 1, the scroll compression mechanism 15 principally comprises: a housing 23; a fixed scroll 24, which is disposed above the housing 23 in tight contact therewith; and a movable scroll 26, which meshes with the fixed scroll 24. The text below discusses the constituent parts of the scroll compression mechanism 15 in detail.

a) Housing

The housing 23 is press fitted and fixed, at its outer circumferential surface, to the trunk casing part 11 completely therearound in the circumferential directions. In other words, the trunk casing part 11 and the housing 23 are in close contact all the way around their circumferences. Consequently, the interior of the casing 10 is partitioned into a high pressure space 28 below the housing 23 and a low pressure space 29 above the housing 23. In addition, the fixed scroll 24 is fastened and fixed to the housing 23 by a bolt 38 such that an upper end surface of the housing 23 is in close contact with a lower end surface of the fixed scroll 24. In addition, in the housing 23, a housing recessed part 31 is formed such that it provides a recess in the center of the upper surface of the housing 23, and a bearing part 32 is formed such that it extends below the housing 23 from the center of the lower surface thereof. Furthermore, a bearing hole 33 is formed in the bearing part 32 such that it passes therethrough in the vertical directions, and a main shaft part 17*b* of the crankshaft 17 is rotatably inserted into the bearing hole 33 via a bearing 34.

b) Fixed Scroll

As shown in FIG. 1, the fixed scroll 24 principally comprises: an end plate 24*a*; and a scroll shaped (i.e., involute) wrap 24*b*, which extends downward from a mirror surface of the end plate 24*a* along a direction substantially orthogonal to the mirror surface. A discharge hole 41, which communicates with a compression chamber 40 (discussed below), and an enlarged recessed part 42, which communicates with the discharge hole 41, are formed in the end plate 24*a*. The discharge hole 41 is formed in a center portion of the end plate 24*a* such that it extends in the vertical directions. The enlarged recessed part 42 is formed in the upper surface of the end plate 24*a* such that it widens in the horizontal directions.

Furthermore, a cover body 44 is fastened and fixed to the upper surface of the fixed scroll 24 by a bolt 44*a* such that the cover body 44 covers the enlarged recessed part 42. Furthermore, covering the enlarged recessed part 42 with the cover body 44 forms a muffler space 45, which muffles the operation noise of the scroll compression mechanism 15. Furthermore, the fixed scroll 24 and the cover body 44 are sealed to one another by being brought into tight contact with a gasket (not shown) interposed therebetween.

c) Movable Scroll

Figure 2:
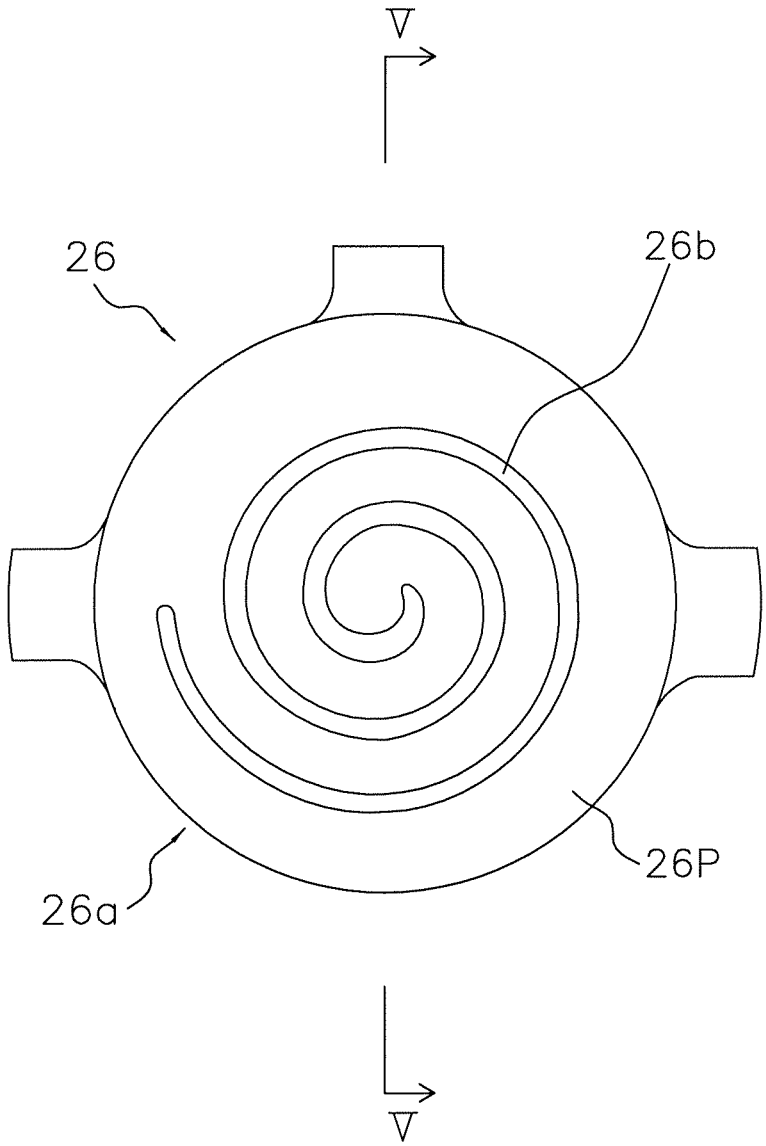
FIG. 2 is a top view of a movable scroll that is incorporated into the high/low pressure dome type scroll compressor according to the embodiment of the present invention.
Figure 3:
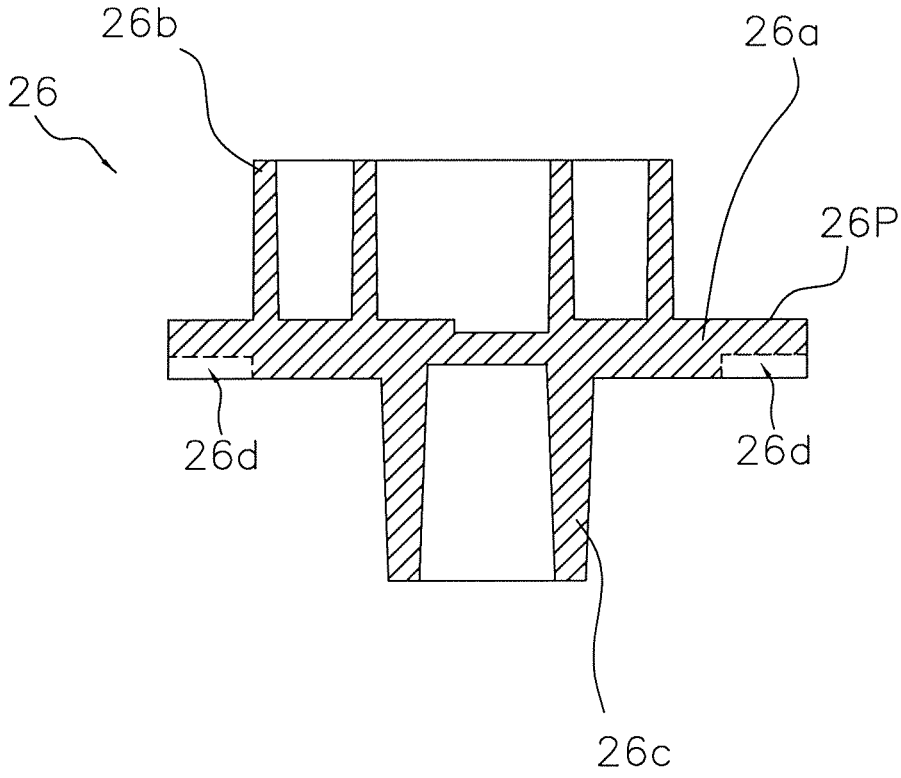
FIG. 3 is a cross sectional view taken along the V-V line of the movable scroll incorporated into the high/low pressure dome type scroll compressor according to the embodiment of the present invention.

The movable scroll 26 is an outer drive type movable scroll and, as shown in FIG. 1, FIG. 2, and FIG. 3, principally comprises: an end plate 26*a*; a scroll shaped (i.e., involute) wrap 26*b*, which extends upward from a mirror surface 26P of the end plate 26*a* in a direction substantially orthogonal to the mirror surface 26P; a bearing part 26*c*, which extends downward from a lower surface of the end plate 26*a* and fits an outer side of an eccentric shaft part 17*a* of the crankshaft 17; and groove parts 26*d* (refer to FIG. 3), which are formed on opposite end parts of the end plate 26*a*.

Furthermore, by fitting the Oldham ring 39 into the groove parts 26*d* (refer to FIG. 1), the movable scroll 26 is supported by the housing 23. In addition, the eccentric shaft part 17*a* of the crankshaft 17 is fitted into the bearing part 26*c*. By incorporating the movable scroll 26 into the scroll compression mechanism 15 in this manner, the movable scroll 26 revolves inside the housing 23 without rotating on its own axis by the rotation of the crankshaft 17. Furthermore, the wrap 26*b* of the movable scroll 26 is meshed with the wrap 24*b* of the fixed scroll 24, and thereby the compression chamber 40 is formed between the parts at which the wraps 24*b*, 26*b* contact one another. Furthermore, the revolving of the movable scroll 26 displaces the compression chamber 40 toward its center, thereby shrinking the volume of the compression chamber 40. In so doing, in the high/low pressure dome type scroll compressor 1, the gas refrigerant that enters the compression chamber 40 is compressed.

d) Other

In addition, in the scroll compression mechanism 15, a communicating passageway 46 is formed that spans the fixed scroll 24 and the housing 23. The communicating passageway 46 comprises: a scroll side passageway 47, which is formed as a notch in the fixed scroll 24; and a housing side passageway 48, which is formed as a notch in the housing 23. Furthermore, the upper end of the communicating passageway 46, namely, the upper end of the scroll side passageway 47, is open to the enlarged recessed part 42; furthermore, the lower end of the communicating passageway 46, namely, the lower end of the housing side passageway 48, is open to the lower end surface of the housing 23. In other words, the lower end opening of the housing side passageway 48 constitutes a discharge port 49 wherethrough the refrigerant in the communicating passageway 46 flows out to the gap space 18.

(3) Oldham Ring

The Oldham ring 39 is a member for preventing the movable scroll 26 from rotating about its own axis and is fitted into Oldham grooves (not shown), which are formed in the upper surface of the housing 23. Furthermore, the Oldham grooves are elliptical and are provided and disposed in the housing 23 such that they oppose one another.

(4) Drive Motor

The drive motor 16 is a DC motor and principally comprises: an annular stator 51, which is fixed to an inner wall surface of the casing 10; and a rotor 52, which is rotatably housed on the inner side of the stator 51 with a small gap (i.e., an air gap passageway) therebetween. Furthermore, the drive motor 16 is disposed such that an upper end of a coil end 53, which is formed in an upper side of the stator 51, is at substantially the same height position as the lower end of the bearing part 32 of the housing 23.

In the stator 51, copper wire is wound around teeth parts, and the coil ends 53 are formed above and below the stator 51. In addition, core cut parts, which are formed as notches in a plurality of locations with a prescribed spacing in circumferential directions and such that they span from the upper end surface to the lower end surface of the stator 51, are provided in the outer circumferential surface of the stator 51. Furthermore, the core cut parts form a motor cooling passageway 55, which extends in the vertical directions between the trunk casing part 11 and the stator 51.

The rotor 52 is drivably coupled to the movable scroll 26 of the scroll compression mechanism 15 via the crankshaft 17, which is disposed at the axial center of the trunk casing part 11 such that it extends in the vertical directions. In addition, a guide plate 58, which guides the refrigerant that flows out of the discharge port 49 of the communicating passageway 46 to the motor cooling passageway 55, is provided and disposed in the gap space 18.

(5) Crankshaft

The crankshaft 17 is a substantially columnar monolithically molded part, as shown in FIG. 1, and principally comprises the eccentric shaft part 17*a*, the main shaft part 17*b*, a balance weight part 17*c*, and an auxiliary shaft part 17*d*. The eccentric shaft part 17*a* is housed in the bearing part 26*c* of the movable scroll 26. The main shaft part 17*b* is housed in the bearing hole 33 of the housing 23 via the bearing 34. The auxiliary shaft part 17*d* is housed in the lower part main bearing 60.

(6) Lower Part Main Bearing

The lower part main bearing 60 is provided and disposed in a lower space below the drive motor 16. The lower part main bearing 60 is fixed to the trunk casing part 11, constitutes a lower end side bearing of the crankshaft 17, and houses the auxiliary shaft part 17*d* of the crankshaft 17.

(7) Suction Pipe

The suction pipe 19 is for guiding the refrigerant in the refrigerant circuit to the scroll compression mechanism 15 and is hermetically fitted to the upper wall part 12 of the casing 10. The suction pipe 19 passes through the low pressure space 29 in the vertical directions; furthermore, an inner end part of the suction pipe 19 is fitted into the fixed scroll 24.

(8) Discharge Pipe

The discharge pipe 20 is for discharging the refrigerant inside the casing 10 to the outside of the casing 10 and is hermetically fitted to the trunk casing part 11 of the casing 10. Furthermore, the discharge pipe 20 comprises an inner end part 36, which is formed as a cylinder that extends in the vertical directions and is fixed to the lower end part of the housing 23. Furthermore, the inner end opening, namely, the inflow port, of the discharge pipe 20 is open downward.

<Operation of the High/Low Pressure Dome Type Scroll Compressor>

Next, the operation of the high/low pressure dome type scroll compressor 1 will be explained in simple terms. First, when the drive motor 16 is driven, the crankshaft 17 rotates and the movable scroll 26 revolves without rotating about its axis. In so doing, low pressure gas refrigerant is suctioned from the circumferential edge side of the compression chamber 40 through the suction pipe 19 into the compression chamber 40, is compressed as the volume of the compression chamber 40 changes, and thereby transitions to high pressure gas refrigerant. Furthermore, the high pressure gas refrigerant is discharged from a center part of the compression chamber 40 through the discharge hole 41 to the muffler space 45, subsequently flows out to the gap space 18 through the communicating passageway 46, the scroll side passageway 47, the housing side passageway 48, and the discharge port 49, and flows toward the lower side between the guide plate 58 and an inner surface of the trunk casing part 11. Furthermore, when the gas refrigerant flows toward the lower side between the guide plate 58 and the inner surface of the trunk casing part 11, a portion of the gas refrigerant splits off and flows in the circumferential directions between the guide plate 58 and the drive motor 16. Furthermore, at this time, lubricating oil that is mixed in the gas refrigerant separates out. Moreover, another portion of the split off gas refrigerant flows toward the lower side through the motor cooling passageway 55, flows as far as a lower space of the motor, and subsequently reverses direction and flows upward through the air gap passageway between the stator 51 and the rotor 52 or through the motor cooling passageway 55 on the side opposing the communicating passageway 46 (in FIG. 1, the left side). Thereafter, the gas refrigerant that passes through the guide plate 58 and the gas refrigerant that flows through the air gap passageway or the motor cooling passageway 55 merge at the gap space 18; furthermore, the merged gas refrigerant flows from the inner end part 36 of the discharge pipe 20 into the discharge pipe 20 and is then discharged to the outside of the casing 10. Furthermore, the gas refrigerant that discharges to the outside of the casing 10 circulates through the refrigerant circuit, subsequently passes through the suction pipe 19 once again, and is suctioned into and compressed by the scroll compression mechanism 15.

<Method of Manufacturing the Sliding Part>

In the high/low pressure dome type scroll compressor 1 according to the embodiment of the present invention, the crankshaft 17, the housing 23, the fixed scroll 24, the movable scroll 26, the Oldham ring 39, and the lower part main bearing 60 are the sliding parts, which are manufactured using the manufacturing method below.

(1) Raw Materials

A billet to which C, 2.2-2.5 wt %, Si: 1.8-2.2 wt %, Mn: 0.5-0.7 wt %, P: <0.035 wt %, S: <0.04 wt %, Cr: 0.00-0.50 wt %, Ni: 0.50-1.00 wt % has been added is used as the iron raw material, which is the raw material of the sliding parts in the embodiment of the present invention. Furthermore, the weight percentages herein apply to the entire amount of the material. In addition, "billet" herein means a raw material in a state after an iron raw material having the abovementioned composition is first melted in a melting furnace but before its final molding into a column using a continuous casting apparatus. Furthermore, here, the C content and the Si content are determined such that two conditions are satisfied: the tensile strength and the tensile modulus are greater than those in flake graphite cast iron; and a fluidity is provided that is appropriate to molding a sliding part base that has a complex shape. In addition, the Ni content is determined so as to constitute a metal composition that improves the toughness of the metallographic structure and is suited to preventing surface cracks during molding.

(2) Manufacturing Process

The sliding parts according to the embodiment of the present invention are manufactured by undergoing a semimolten die casting process, a heat treatment process, a finishing process, and a partial heat treatment process. The details of each of the processes are discussed below.

a) Semimolten Die Casting Process

In the semimolten die casting process, first, a billet is subjected to high frequency heating so that it transitions to a semimolten state. Next, the billet in the semimolten state is poured into a prescribed mold and molded into a desired shape while a die casting machine applies a prescribed pressure, and thereby the sliding part base is obtained. Furthermore, the sliding part base is quenched and solidified inside the mold, whereupon the metallographic structure of the sliding part base is entirely transformed into white cast iron. Furthermore, the sliding part base is slightly larger than the sliding part that is ultimately obtained, and the sliding part base becomes the final sliding part after the machining allowance is removed in a subsequent finishing process.

Figure 4:
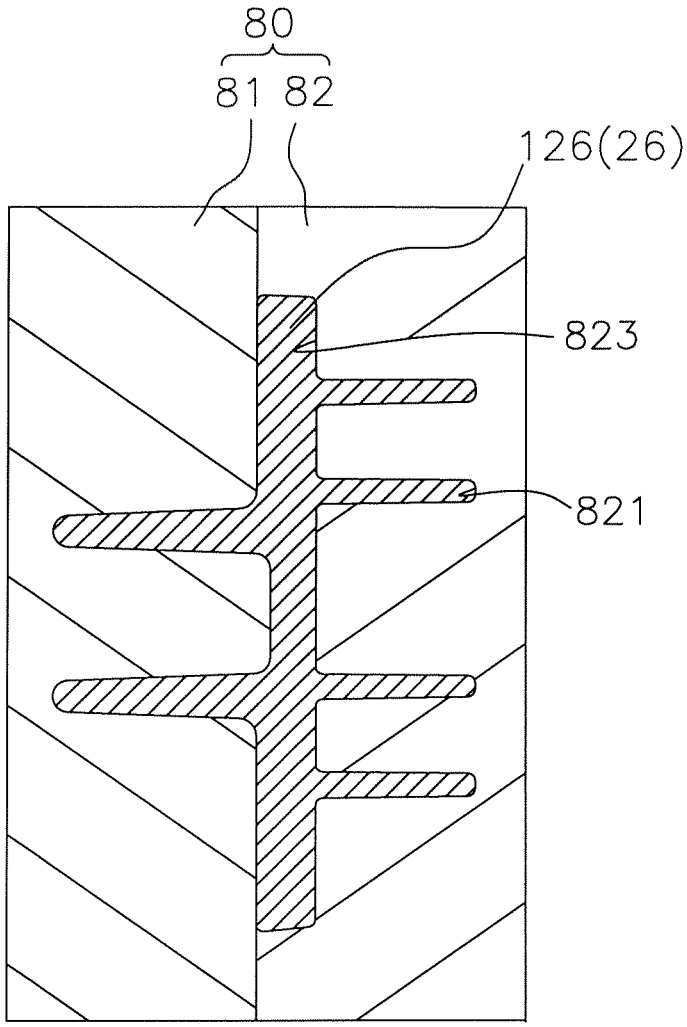
FIG. 4 is a longitudinal cross sectional view of a mold, which is for manufacturing the movable scroll incorporated in the high/low pressure dome type scroll compressor according to an embodiment of the present invention, and a base of the movable scroll formed by semimolten die casting.
Figure 5:
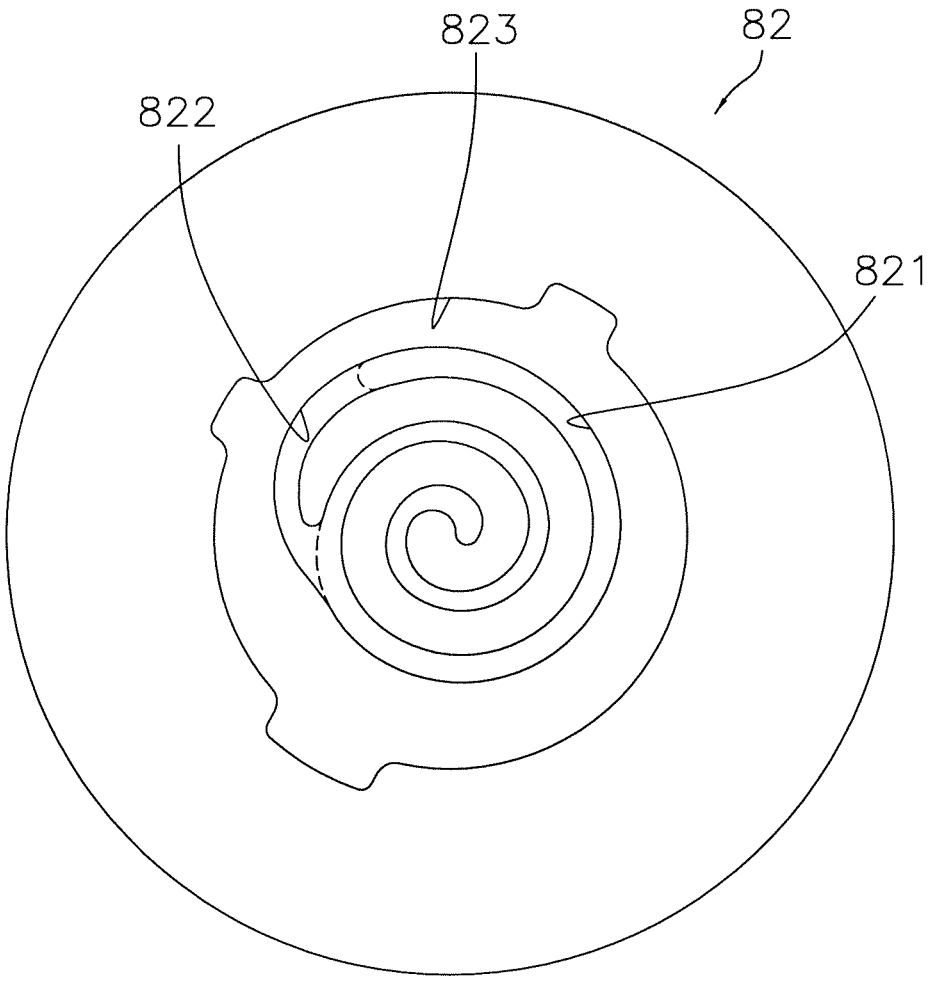
FIG. 5 is a bottom view of an end plate of the mold and a portion on a wrap forming side of the mold for manufacturing the movable scroll that is incorporated into the high/low pressure dome type scroll compressor according to the embodiment of the present invention.

Furthermore, in the embodiment of the present invention, a base 126 of the movable scroll 26 is molded using a mold 80, which is shown in FIG. 4 and FIG. 5.

As shown in FIG. 4, the mold 80 for semimolten die casting the base 126 of the movable scroll 26 comprises a first mold portion 81 and a second mold portion 82. Furthermore, a pouring gate (not shown) is disposed at substantially the center of a portion corresponding to the end plate. Furthermore, as shown in FIG. 4 and FIG. 5, the following parts are formed in the second mold portion 82: a recessed part 823, which is for forming an upper part of the end plate 26*a*; a scroll shaped groove part 821, which is for forming the wrap 26*b*; and a communicating groove part 822, which is for providing communication from the scroll tail end to the inner circumferential side of the scroll shaped groove part 821. Furthermore, to facilitate the removal of the base 126 of the movable scroll 26, the scroll shaped groove part 821 is formed such that its width increases as one proceeds from the bottom part (i.e., the portion corresponding to the tip portion) to the recessed part 823. Accordingly, in the base 126 of the movable scroll 26 formed using the mold 80, the width of the portion corresponding to the wrap increases as one proceeds from the portion corresponding to the tip to the portion corresponding to the end plate. In addition, the portion formed by the communicating groove part 822 is removed in a subsequent finishing process.

b) Heat Treatment Process

In the heat treatment process, the sliding part base is heat treated after it has undergone the semimolten die casting process In the heat treatment process, the metallographic structure of the sliding part base changes from the white cast iron structure to a metallographic structure composed of a pearlite/ferrite and lump graphite. Furthermore, the transformation of the white cast iron structure to graphite and pearlite can be adjusted by adjusting the heat treatment temperature, the hold time, the cooling rate, and the like. As recited in, for example, an article entitled "Research on Technology for Semimolten Casting of Iron" published in the *Honda R&D Technical Review* 14(1), it is possible to obtain a metallographic structure with a tensile strength of approximately 500-700 MPa and a hardness in the range of approximately HB 150 (i.e., HRB 81, which is the converted value based on the SAE J 417 hardness conversion table) to HB 200 (i.e., HRB 96, which is the converted value based on the SAE J 417 hardness conversion table) by holding the temperature of the metal at 950° C. for 60 min. and then annealing the metal in the furnace at a cooling rate of 0.05-0.10° C./s. Such a metallographic structure is mainly ferrite and consequently is soft and has superior machinability; however, during machining, a built-up edge might be formed, which could reduce cutting tool life. In addition, by holding the metal at 1000° C. for 60 min., subsequently air cooling the metal, further holding the metal for a prescribed time at a temperature somewhat lower than the initial temperature, and then air cooling the metal, it is possible to obtain a metallographic structure with a tensile strength of approximately 600-900 MPa and a hardness in the range of approximately HB 200 (i.e., HRB 96, which is the converted value based on the SAE J 417 hardness conversion table) to HB 250 (i.e., HRB 105, HRC 26, which are the converted values based on the SAE J 417 hardness conversion table; note that HRB 105 is a reference value that is used in order to exceed the effective practical range of a test type). In such a metallographic structure, a composition with a hardness equivalent to that of flake graphite cast iron has a machinability equivalent to that of flake graphite cast iron and has superior machinability compared to that of nodular graphite cast iron having an equivalent ductility and toughness. In addition, by holding the metal at a temperature of 1000° C. for 60 min., subsequently oil cooling the metal, further holding the metal for a prescribed time at a temperature slightly lower than the initial temperature, and then air cooling the metal, it is possible to obtain a metallographic structure with a tensile strength of approximately 800-1300 MPa and a hardness in the range of approximately HB 250 (i.e., HRB 105, HRC 26, which are the converted values based on the SAE J 417 hardness conversion table; note that HRB 105 is a reference value that is used in order to exceed the effective practical range of a test type) to HB 350 (i.e., HRB 122, HRC 41, which are the converted values based on the SAE J 417 hardness conversion table; note that HRB 122 is a reference value that is used in order to exceed the effective practical range of a test type). Such a metallographic structure is mainly pearlite and consequently is hard and has poor machinability but superior abrasion resistance. However, the metal's excessive hardness might cause it to attack the sliding counterpart.

Note that, in the heat treatment process according to the embodiment of the present invention, heat treatment is performed under conditions such that the hardness of the sliding part base becomes greater than HRB 90 (i.e., HB 176, which is the converted value based on the SAE J 417 hardness conversion table) and less than HRB 100 (i.e., HB 219, which is the converted value based on the SAE J 417 hardness conversion table).

c) Finishing Process

In the finishing process, the sliding part base is machined, which completes the sliding part.

<Mold Damaging Mechanism>

Figure 6:
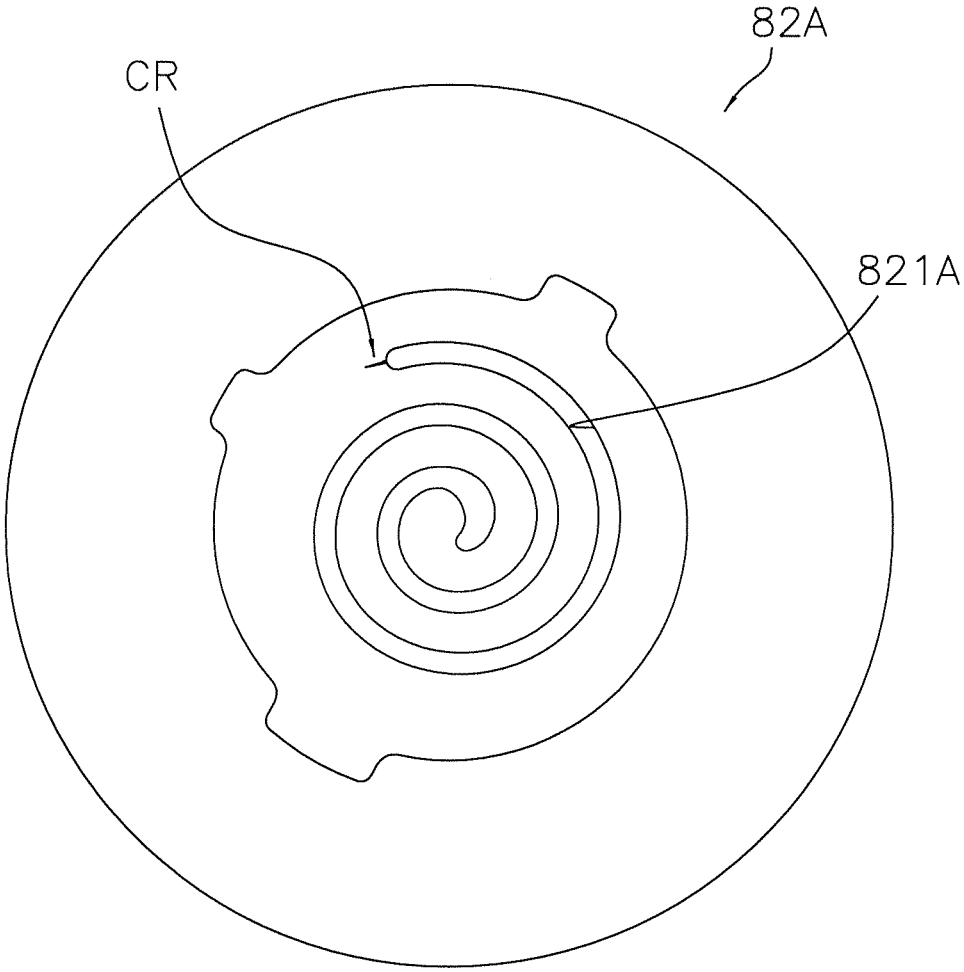
(Prior Art) FIG. 6
FIG. 6 is a bottom view of an end plate and a portion on a wrap forming side of a conventional mold for manufacturing the movable scroll.

The text below explains a case wherein a mold with a conventional second mold portion, as shown in FIG. 6, is used in semimolten die casting, semisolid die casting, and the like, referencing a mold damaging mechanism. Note that, a first mold portion is identical to the first mold portion discussed above.

Figure 8:
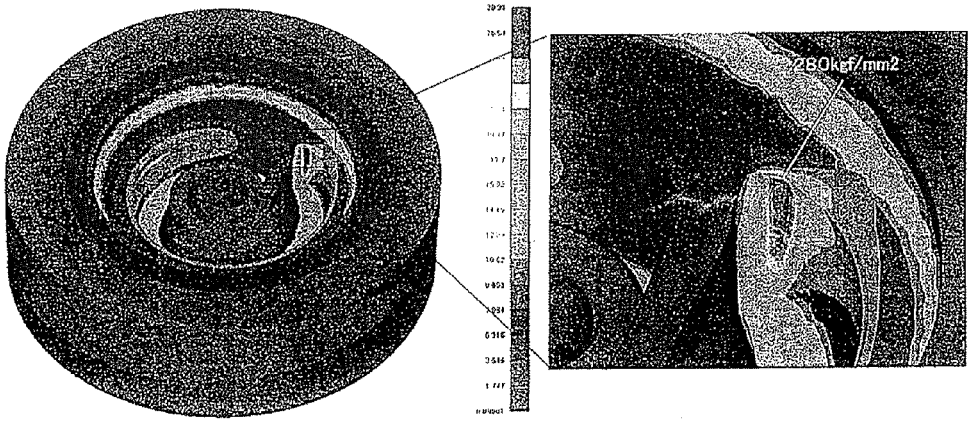
(Prior Art) FIG. 8
FIG. 8 shows the analysis results of stress that occurs when pressure is applied to semimolten metal in the conventional mold.

First, while pressure is applied to semimolten metal at a high temperature in the mold 80, a force is created that presses a groove wall (hereinbelow, called a "outer circumferential end groove wall") in the vicinity of a scroll tail end (i.e., the end on the outer circumferential side) of a scroll shaped groove part 821A of a second mold portion 82A. In other words, at this time, the outer circumferential end groove wall bears a tensile load. Furthermore, FIG. 8 shows the results (as a contour diagram) of analyzing the tensile stress exerted upon the outer circumferential end groove wall.

Figure 7:
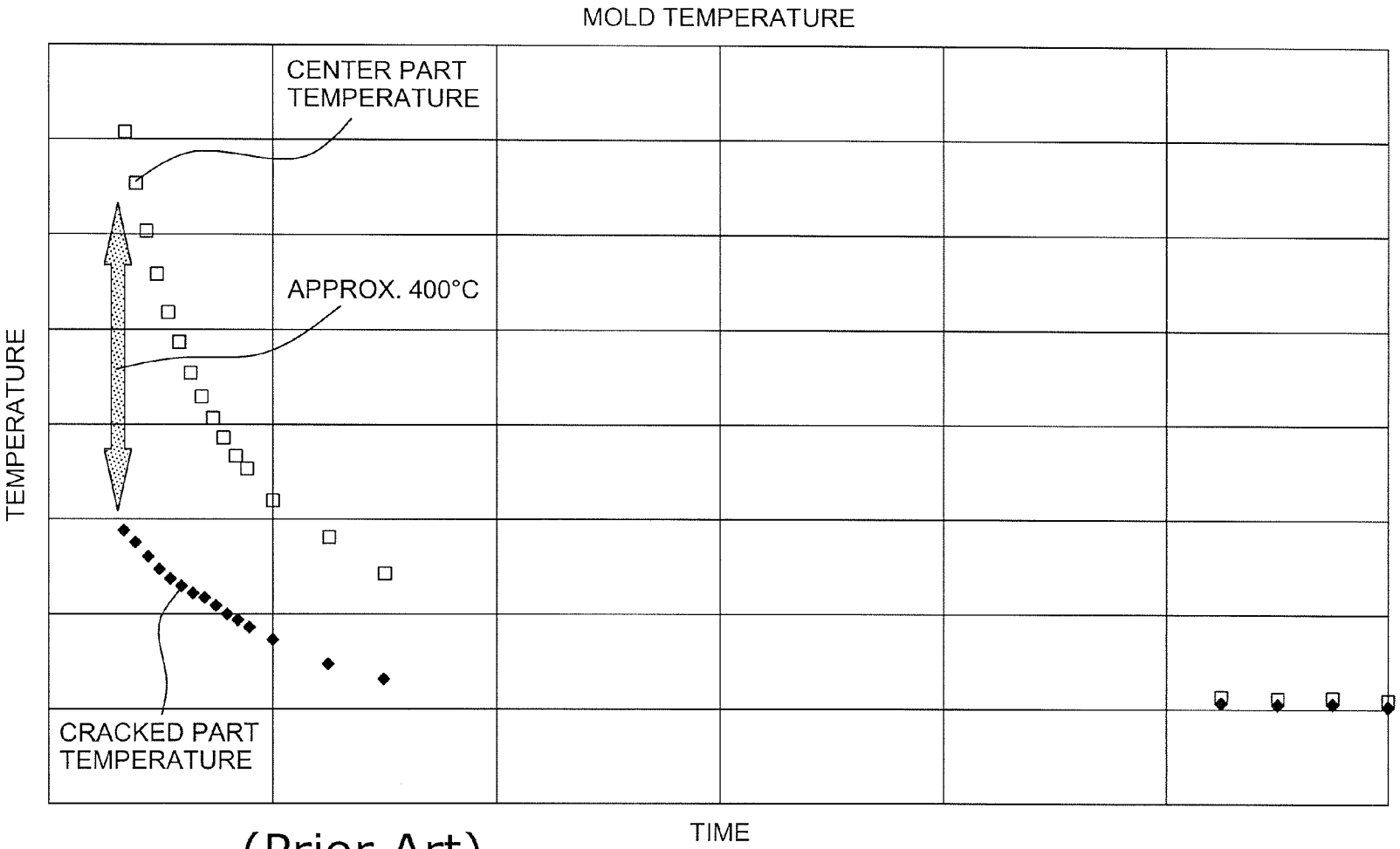
(Prior Art) FIG. 7
FIG. 7 is a graph that shows a time series of actually measured temperature values when the movable scroll is formed using a conventional mold.
Figure 10:
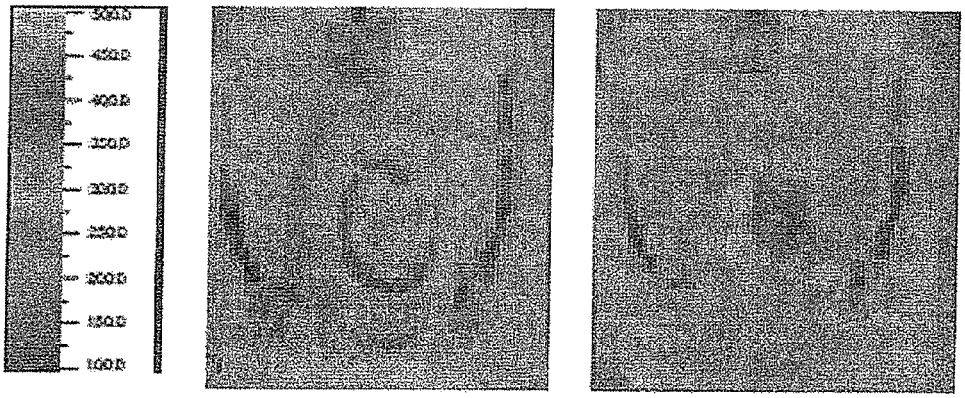
(Prior Art) FIG. 10
FIG. 10 shows the results of using a thermoviewer to measure the temperature of the conventional mold.
Figure 11:
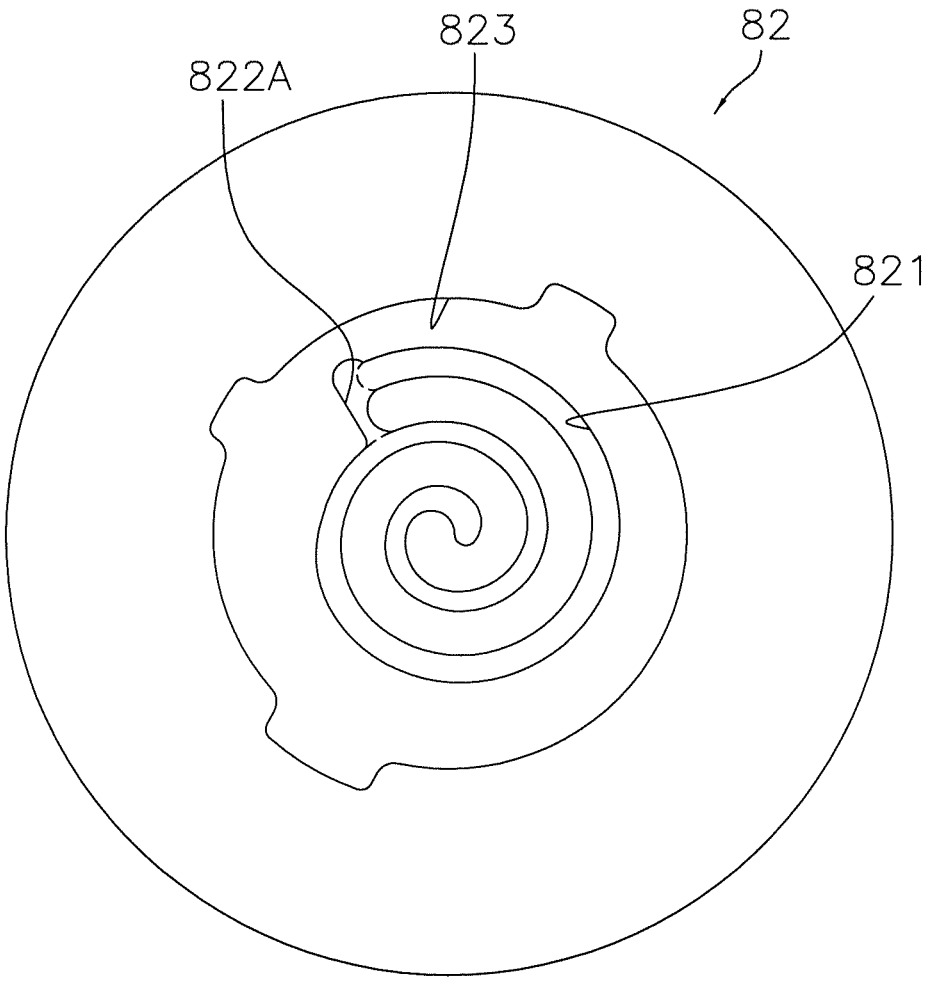
FIG. 11 is a bottom view of the end plate and a portion of the mold on the wrap forming side according to a modified example (A).
Figure 12:
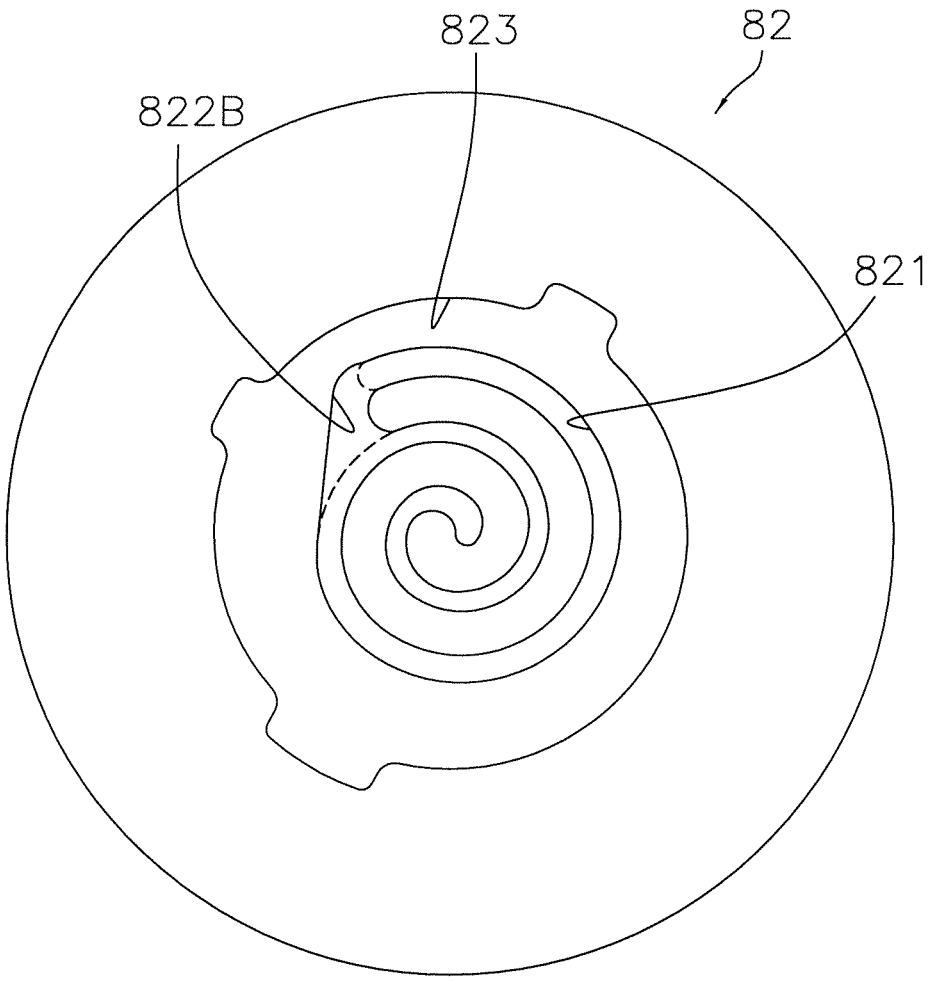
FIG. 12 is a bottom view of the end plate and a portion of the mold on the wrap forming side according to the modified example (A).

Next, the transfer of heat from the high temperature semimolten metal filling the mold 80 rapidly raises the temperature of the mold 80; after several seconds, when the molded part is removed, the temperature of the mold 80 falls starting from the outer circumferential side. Furthermore, FIG. 7 shows a time series diagram of the actual measured temperatures at the center part groove wall and the outer circumferential end groove wall of the mold 80. In addition, FIG. 10 shows the results of using a thermoviewer to measure the temperature of the mold 80.

Figure 9:
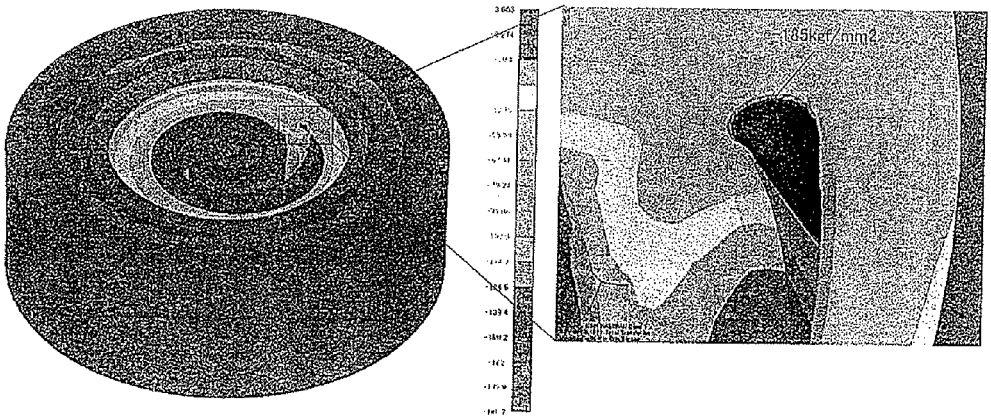
(Prior Art) FIG. 9
FIG. 9 shows analysis results of stress that is generated by thermal deformation in the conventional mold.

Furthermore, when a large temperature differential arises between the center part groove wall and the outer circumferential end groove wall of the mold 80 in this manner, a compressive load owing to thermal expansion is exerted upon the outer circumferential end groove wall. Furthermore, FIG. 9 shows the results (as a contour diagram) of analyzing the compressive stress exerted upon the outer circumferential end groove wall.

Accordingly, in such a mold 80, the outer terminal end groove wall alternately and repetitively bears a tensile load owing to pressurization and a compressive load owing to thermal expansion; as a result, a stress of stress amplitude is created in the outer circumferential end groove wall. Furthermore, if the stress amplitude exceeds the fatigue limit of the material of the mold 80, then a fatigue failure will occur and a crack CR will be created in the outer circumferential end groove wall.

<Features of the Mold>

The communicating groove part 822 is formed in the mold 80 according to the present embodiment. Consequently, the outer circumferential end groove wall, which exists in the conventional mold, does not exist in the mold 82. Accordingly, in the mold 82, it is possible to prevent the stress concentration on a part of the groove wall as well as to greatly reduce the magnitude of the stress amplitude. Thereby, if such a mold is used in semimolten die casting, semisolid die casting, or the like, it is possible to reduce the stress-induced load of the mold and, in turn, to extend the life span of the mold by tenfold or greater.

Modified Examples

(A)

Figure 13:
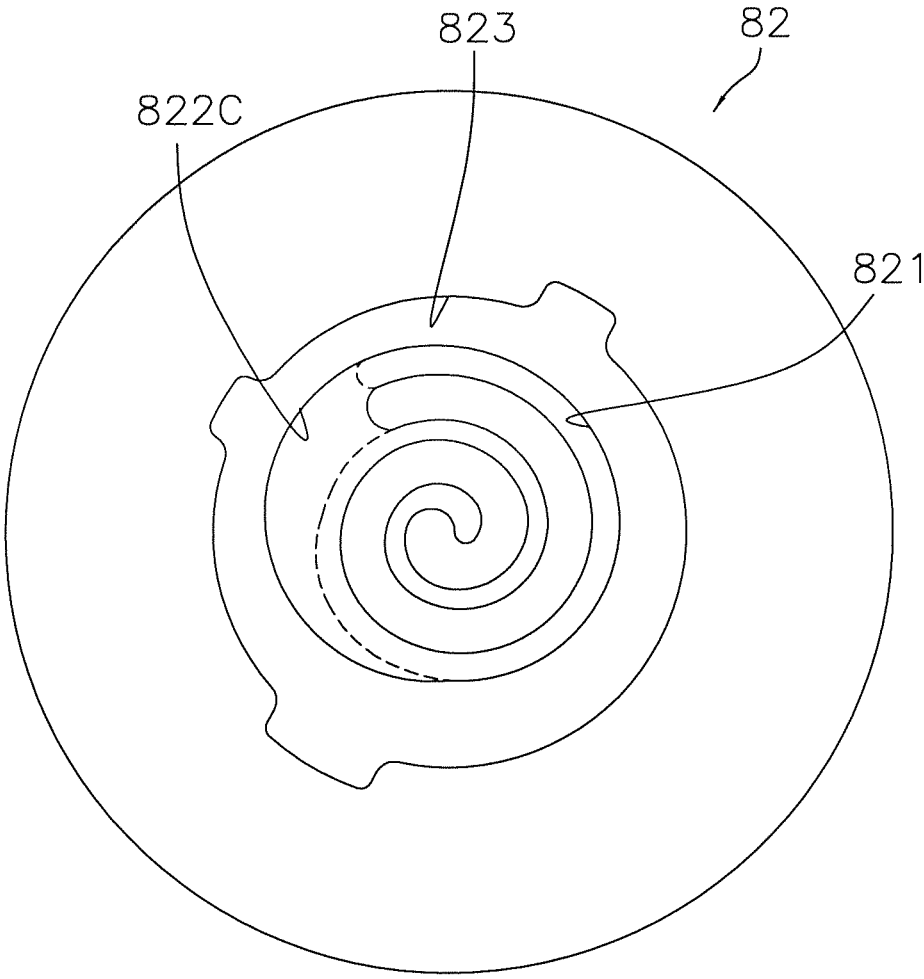
FIG. 13 is a bottom view of the end plate and a portion of the mold on the wrap forming side according to the modified example (A).
Figure 14:
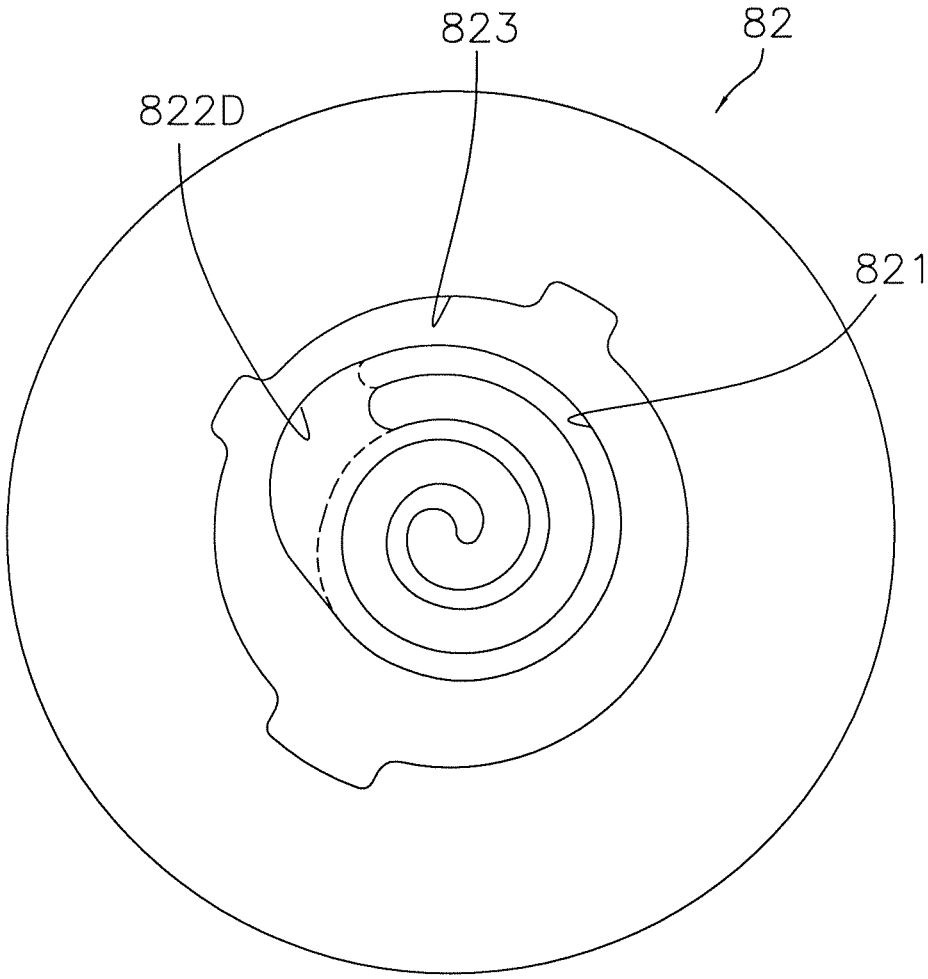
FIG. 14 is a bottom view of the end plate and a portion of the mold on the wrap forming side according to the modified example (A).

In the mold 80 according to the above embodiment, the communicating groove part 822 of the second mold portion 82 is shaped as shown in FIG. 5, but the shape of the communicating groove part is not particularly limited thereto; for example, communicating groove parts 822A, 822B, 822C, 822D as shown in FIG. 11 through FIG. 14 may be formed. Furthermore, based on the results of stress analysis (taking into consideration the mean stress, the stress amplitude, a safety factor with respect to the fatigue limit, and the like), the shapes shown in FIG. 13 and FIG. 14, namely, the shapes of the communicating groove parts 822C, 822D, are particularly preferable. In FIG. 13, the outer peripheries of the scroll shaped groove part 821 and the communicating groove part 822C have a nearly arcuate shape in a bottom view. In addition, in FIG. 14, the outer periphery of the communicating groove part 822D in a bottom view has an arc and a tangent, which extends from a point on the outer periphery of the scroll shaped groove part 821.

(B)

Figure 15:
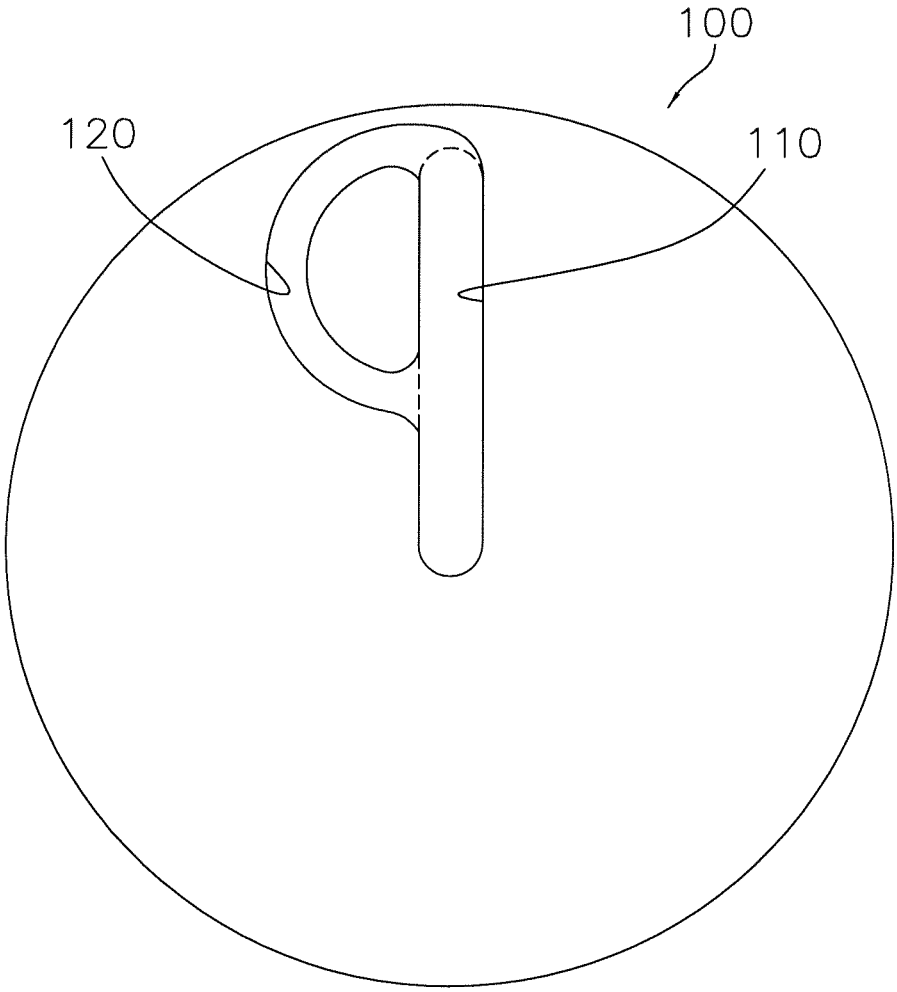
FIG. 15 is a top view of a mold portion according to a modified example (B).
Figure 16:
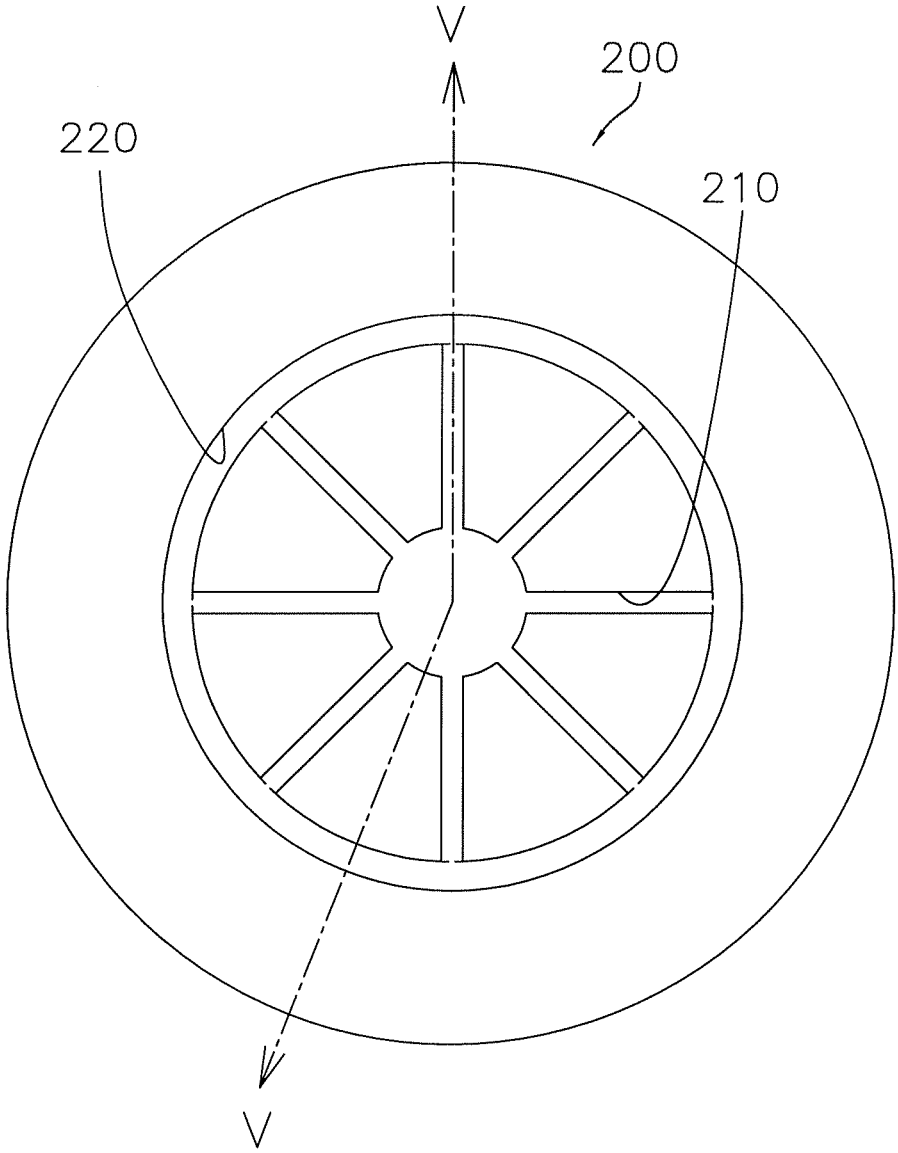
FIG. 16 is a top view of a portion of the mold—on the side whereon reinforcing ribs are formed—for manufacturing a housing according to the modified example (B).
Figure 17:
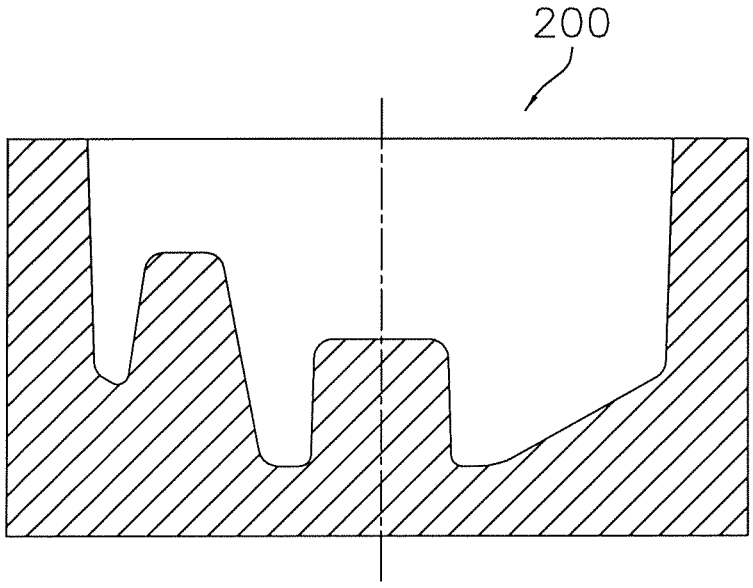
FIG. 17 is a cross sectional view taken along the V-V line of the mold for manufacturing the housing according to the modified example (B).
Figure 18:
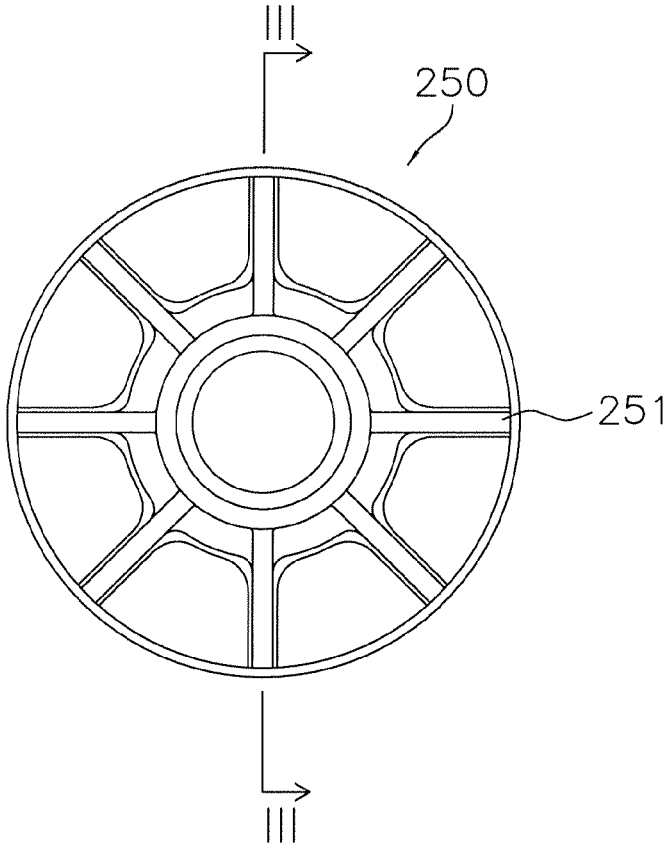
FIG. 18 is a bottom view of the housing according to the modified example (B).
Figure 19:
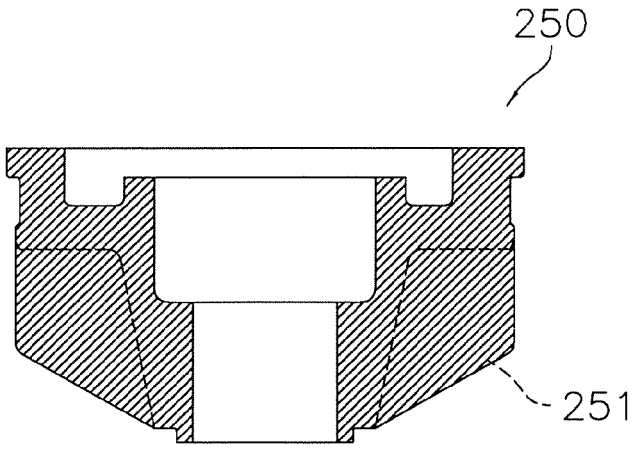
FIG. 19 is a cross sectional view taken along the line of the housing according to the modified example (B).

In the above embodiment, the present invention is adapted to a mold for molding the movable scroll 26, but the present invention may also be adapted to a mold for molding other components such as a fixed scroll or a housing. For example, a mold portion 100 as shown in FIG. 15 may be used to mold a flat plate member. Note that, in such a case, a groove part 110 corresponds to a molded part portion and a groove part 120 is a communicating groove part and corresponds to a portion to be removed by machining and the like. In addition, a mold 200 as shown in FIG. 16 and FIG. 17 may be used to mold, for example, a housing 250 that comprises reinforcing ribs 251 as shown in FIG. 18 and FIG. 19. Note that, in such a case, groove parts 210 correspond to the reinforcing ribs 251 and a groove part 220 is a communicating groove part and corresponds to a portion to be removed by machining and the like.

(C)

The above embodiment adopts a hermetic type compressor as the high/low pressure dome type scroll compressor 1, but the high/low pressure dome type scroll compressor 1 may be a high pressure dome type compressor or a lower pressure dome type compressor. In addition, it may be a semihermetic type compressor or an open type compressor.

(D)

In the above embodiment, a billet to which C, 2.2-2.5 wt %, Si: 1.8-2.2 wt %, Mn: 0.5-0.7 wt %, P: <0.035 wt %, S: <0.04 wt %, Cr: 0.00-0.50 wt %, Ni: 0.50-1.00 wt % has been added is used as the iron raw material, but the percentages of the elements in the iron raw material can be determined arbitrarily as long as the percentages do not depart from the spirit of the invention.

(E)

In the above embodiment, the Oldham ring 39 is used as the rotation preventing mechanism, but any mechanism, such as a pin, a ball coupling, or a crank, may be used as the rotation preventing mechanism.

(F)

The above embodiment described an exemplary case wherein the scroll compressor 1 is used inside the refrigerant circuit, but the application of the scroll compressor 1 is not limited to air conditioning, and the present invention can also be adapted to a compressor, a fan, a supercharger, a pump, or the like—either as a standalone or embedded in a system.

(G)

In the scroll compressor 1 according to the above embodiment, lubricating oil is present, but the scroll compressor 1 may be an oilless or oil-free (i.e., with or without oil) type compressor, fan, supercharger, or pump.

(H)

The high/low pressure dome type scroll compressor 1 according to the above embodiment is an outer drive type scroll compressor but may be an inner drive type scroll compressor.

(I)

In the movable scroll 26 according to the above embodiment, the notches are formed by, for example, end milling, but a notch (i.e., counterbore) may be preformed by a semimolten die casting process in the center portion of the upper surface of the end plate 26*a* of the movable scroll 26 shown in FIG. 5.

(J)

In the above embodiment, iron raw material is used as the raw material of the sliding parts, but a metal material other than iron may be used as it does not depart from the spirit of the invention.

INDUSTRIAL APPLICABILITY

The mold according to the present invention features a long lifespan when used to manufacture a molding using a semimolten die casting method or a semisolid die casting method and is extremely useful when manufacturing a molded part by a semimolten die casting method or a semisolid die casting method.

What is claimed is:

1. A molding manufacturing method comprising:

providing a mold having a first groove part extending with a constant length or a constant width from a center part to an outer circumferential part of the mold; and a second groove part extending from a terminal end of the first groove part on an outer circumferential part side of the first groove part and merging with any portion of the first groove part, the second groove part extending between two adjacent, spaced portions of the first groove part so as to connect the two adjacent, spaced portions;

manufacturing a preform by semimolten die casting or semisolid die casting using the mold such that the preform has a first molded portion corresponding to the first groove part and a second molded portion corresponding to the second groove part, the first molded portion having a terminal end that is connected to an adjacent, spaced part of the first molded portion by the second molded portion before removing the second molded portion; and removing the second molded portion of the preform corresponding to the second groove part such that the terminal end of the first molded portion becomes a free end that is free from connection with the adjacent, spaced part as viewed along a circumferential center of the first molded portion with the terminal end and the adjacent, spaced part of the first molded portion being separated by a gap, the gap being disposed where the second molded portion of the preform was disposed prior to removal.

2. The molding manufacturing method according to claim 1, wherein the providing of the mold includes providing the mold such that the first groove part is a scroll shaped groove part that extends in one direction and maintains a scroll shape, and such that the second groove part extends from a scroll tail end of the scroll shaped groove part and merges with any portion of the scroll shaped groove part.

3. The molding manufacturing method according to claim 1, wherein the providing of the mold includes providing the mold such that an outer periphery of the second groove part has an arc shaped section, as viewed in a depth direction thereof.

4. The molding manufacturing method according to claim 1, wherein the providing of the mold includes providing the mold such that an outer periphery of the second groove part has an arc shaped section and a tangent shaped section, as viewed in a depth direction thereof, and the tangent shaped section extends from an arbitrary point along the outer periphery of the scroll shaped groove part.

5. The molding manufacturing method according to claim 1, wherein the providing of the mold includes providing the mold such that the first groove part has a plurality of groove sections extending radially from the center part to the outer circumferential part, and the second groove part merges with terminal end portions of all of the groove sections on outer peripheral part sides thereof.

6. The molding manufacturing method according to claim 1, wherein the providing of the mold includes providing the mold such that the second groove part connects a terminal end of the first groove part to a radially inward portion of the first groove part at a location circumferentially spaced from the terminal end of the first groove part.

7. The molding manufacturing method according to claim 1, wherein the providing of the mold includes providing the mold such that the second groove part extends radially outward of a radially outermost point on a terminal end of the first groove part.

8. The molding manufacturing method according to claim 5, wherein the providing of the mold includes providing the mold such that the second groove part merges with each of the terminal end portions of the first groove part at respective locations circumferentially spaced along the second groove part.

* * * * *